US007126568B2

(12) United States Patent
LeChevalier

(10) Patent No.: US 7,126,568 B2
(45) Date of Patent: Oct. 24, 2006

(54) METHOD AND SYSTEM FOR PRECHARGING OLED/PLED DISPLAYS WITH A PRECHARGE LATENCY

(75) Inventor: Robert LeChevalier, Golden, CO (US)

(73) Assignee: Clare Micronix Integrated Systems, Inc., Alison Viejo, CA (US)

( * ) Notice: Subject to any disclaimer, the term of this patent is extended or adjusted under 35 U.S.C. 154(b) by 394 days.

(21) Appl. No.: 10/274,421

(22) Filed: Oct. 17, 2002

(65) Prior Publication Data

US 2003/0142088 A1 Jul. 31, 2003

Related U.S. Application Data

(60) Provisional application No. 60/342,637, filed on Oct. 19, 2001, provisional application No. 60/343,856, filed on Oct. 19, 2001, provisional application No. 60/343,638, filed on Oct. 19, 2001, provisional application No. 60/342,582, filed on Oct. 19, 2001, provisional application No. 60/346,102, filed on Oct. 19, 2001, provisional application No. 60/353,753, filed on Oct. 19, 2001, provisional application No. 60/342,793, filed on Oct. 19, 2001, provisional application No. 60/342,791, filed on Oct. 19, 2001, provisional application No. 60/343,370, filed on Oct. 19, 2001, provisional application No. 60/342,783, filed on Oct. 19, 2001, provisional application No. 60/342,794, filed on Oct. 19, 2001.

(51) Int. Cl.
*G09G 3/36* (2006.01)

(52) U.S. Cl. ..... 345/84; 345/82; 315/169.1

(58) Field of Classification Search ..... 345/84, 345/78, 82, 74.1, 75.2; 315/169.1, 315/169.3, 169.5
See application file for complete search history.

(56) References Cited

U.S. PATENT DOCUMENTS 4,236,199 A 11/1980 Stewart
4,366,504 A 12/1982 Kanatani (Continued)

FOREIGN PATENT DOCUMENTS

EP 0 678 849 A1 10/1995

(Continued)

OTHER PUBLICATIONS

International Search Report dated Apr. 8, 2004 for International Application Nol. PCT/US02/33373.

(Continued)

*Primary Examiner*—Richard Hjerpe
*Assistant Examiner*—Jean Lesperance
(74) *Attorney, Agent, or Firm*—Knobbe, Martens, Olson & Bear LLP

(57) ABSTRACT

An organic light emitting diode (OLED)/polymer OLED (PLED) displays and operation with a precharge latency. Particularly, precharging operation of such a display device with a precharge switch latency. According to the operation, a capacitive aspect of a display element is precharged, and the display element is activated so as to conducting a current therethrough. The precharging is terminated after the activation of the display element. Then a current is supplied and conducted through the display element for exposure of the display element. In this operation, a precharge droop that may occur during the transition between precharge and exposure can be avoided or minimized.

25 Claims, 5 Drawing Sheets

U.S. PATENT DOCUMENTS

| | | | | |
|---|---|---|---|---|
| 4,603,269 | A | 7/1986 | Hochstein | |
| RE32,526 | E | 10/1987 | Hochstein | |
| 4,823,121 | A | 4/1989 | Sakamoto et al. | |
| 5,117,426 | A | 5/1992 | McAdams | |
| 5,162,688 | A | 11/1992 | Bouton | |
| 5,514,995 | A | 5/1996 | Hennig | |
| 5,519,712 | A | 5/1996 | Shu et al. | |
| 5,594,463 | A | 1/1997 | Sakamoto | |
| 5,606,527 | A | 2/1997 | Kwack et al. | |
| 5,672,992 | A | 9/1997 | Nadd | |
| 5,686,936 | A | 11/1997 | Maekawa et al. | |
| 5,689,208 | A | 11/1997 | Nadd | |
| 5,708,454 | A | 1/1998 | Katoh et al. | |
| 5,764,207 | A | 6/1998 | Maekawa et al. | |
| 5,781,168 | A * | 7/1998 | Osada et al. | 345/76 |
| 5,818,268 | A | 10/1998 | Kim et al. | |
| 5,844,368 | A | 12/1998 | Okuda et al. | |
| 5,949,194 | A | 9/1999 | Kawakami et al. | |
| 5,952,789 | A | 9/1999 | Stewart et al. | |
| 6,067,061 | A | 5/2000 | Friedman | |
| 6,075,739 | A | 6/2000 | Ihara | |
| 6,181,314 | B1 | 1/2001 | Nakajima et al. | |
| 6,191,534 | B1 | 2/2001 | Schuler et al. | |
| 6,201,717 | B1 | 3/2001 | Grant | |
| 6,229,508 | B1 | 5/2001 | Kane | |
| 6,313,819 | B1 | 11/2001 | Maekawa et al. | |
| 6,366,116 | B1 | 4/2002 | Juang | |
| 6,369,786 | B1 * | 4/2002 | Suzuki | 345/77 |
| 6,433,488 | B1 | 8/2002 | Bu | |
| 6,448,948 | B1 | 9/2002 | Friedman | |
| 6,473,064 | B1 | 10/2002 | Tsuchida et al. | |
| 6,489,631 | B1 * | 12/2002 | Young et al. | 257/59 |
| 6,583,775 | B1 | 6/2003 | Sekiya et al. | |
| 6,584,589 | B1 | 6/2003 | Perner et al. | |
| 6,594,606 | B1 | 7/2003 | Everitt | |
| 6,633,135 | B1 | 10/2003 | Nara et al. | |
| 6,650,308 | B1 * | 11/2003 | Kawashima | 345/76 |
| 6,661,401 | B1 | 12/2003 | Sekine | |
| 6,714,177 | B1 | 3/2004 | Ishizuka | |
| 6,859,193 | B1 * | 2/2005 | Yumoto | 345/82 |
| 2001/0024186 | A1 | 9/2001 | Kane et al. | |

FOREIGN PATENT DOCUMENTS

| | | | |
|---|---|---|---|
| EP | 1 071 070 | A2 | 1/2001 |
| EP | 1 081 836 | A2 | 3/2001 |
| EP | 1 071 070 | A3 | 1/2002 |
| GB | 2 337 354 | A | 12/1995 |
| GB | 2 339 638 | A | 2/2000 |
| JP | 07-199861 | | 6/1984 |
| JP | 59-97223 | | 6/1984 |
| JP | 4-172963 | | 6/1992 |
| JP | 7-322605 | | 12/1995 |
| JP | 11-330376 | | 11/1999 |
| WO | WO 01/27910 | A1 | 4/2001 |

OTHER PUBLICATIONS

International Search Report for International Application No. PCT/US02/33426, filed Oct. 17, 2002, dated Jun. 23, 2003.
International Search Report dated Jun. 26, 2003 for International Application No. PCT/US02/33364, filed Oct. 17, 2002.
International Search Report dated Jun. 26, 2003 for International Application No. PCT/US02/33428, filed Oct. 17, 2002.
International Search Report dated Jun. 26, 2003 for International Application No. PCT/US02/33519, filed Oct. 17, 2002.
International Search Report dated Nov. 27, 2003 for International Application No. PCT/US02/14699, filed May 7, 2002.
International Search Report dated Nov. 28, 2003 for International Application No. PCT/US02/14686, filed May 7, 2002.
International Search Report for International Application No. PCT/US02/33375, filed Oct. 17, 2002, dated Jun. 23, 2003.
International Search Report for International Application No. PCT/US02/33574, filed Oct. 17, 2002, dated Jun. 23, 2003.

* cited by examiner

NORMAL OPERATION - PRECHARGE

NORMAL OPERATION - DATA OUTPUT

METHOD AND SYSTEM FOR PRECHARGING OLED/PLED DISPLAYS WITH A PRECHARGE LATENCY

RELATED APPLICATIONS

This application claims priority to, and hereby incorporates by reference, the following patent applications:

U.S. Provisional Patent Application No. 60/342,637, filed on Oct. 19, 2001, entitled PROPORTIONAL PLUS INTEGRAL LOOP COMPENSATION USING A HYBRID OF SWITCHED CAPACITOR AND LINEAR AMPLIFIERS;

U.S. Provisional Patent Application No. 60/343,856, filed on Oct. 19, 2001, entitled CHARGE PUMP ACTIVE GATE DRIVE;

U.S. Provisional Patent Application No. 60/343,638, filed on Oct. 19, 2001, entitled CLAMPING METHOD AND APPARATUS FOR SECURING A MINIMUM REFERENCE VOLTAGE IN A VIDEO DISPLAY BOOST REGULATOR;

U.S. Provisional Patent Application No. 60/342,582, filed on Oct. 19, 2001, entitled PRECHARGE VOLTAGE ADJUSTING METHOD AND APPARATUS;

U.S. Provisional Patent Application No. 60/346,102, filed on Oct. 19, 2001, entitled EXPOSURE TIMING COMPENSATION FOR ROW RESISTANCE;

U.S. Provisional Patent Application No. 60/353,753, filed on Oct. 19, 2001, entitled METHOD AND SYSTEM FOR PRECHARGING OLED/PLED DISPLAYS WITH A PRECHARGE SWITCH LATENCY;

U.S. Provisional Patent Application No. 60/342,793, filed on Oct. 19, 2001, entitled ADAPTIVE CONTROL BOOST CURRENT METHOD AND APPARATUS, filed on Oct. 19, 2001;

U.S. Provisional Patent Application No. 60/342,791, filed on Oct. 19, 2001, entitled PREDICTIVE CONTROL BOOST CURRENT METHOD AND APPARATUS;

U.S. Provisional Patent Application No. 60/343,370, filed on Oct. 19, 2001, entitled RAMP CONTROL BOOST CURRENT METHOD AND APPARATUS;

U.S. Provisional Patent Application No. 60/342,783, filed on Oct. 19, 2001, entitled ADJUSTING PRECHARGE FOR CONSISTENT EXPOSURE VOLTAGE; and U.S. Provisional Patent Application No. 60/342,794, filed on Oct. 19, 2001, entitled PRECHARGE VOLTAGE CONTROL VIA EXPOSURE VOLTAGE RAMP;

This application is related to, and hereby incorporates by reference, the following patent applications:

U.S. Provisional Application No. 60/290,100, filed May 9, 2001, entitled "METHOD AND SYSTEM FOR CURRENT BALANCING IN VISUAL DISPLAY DEVICES", U.S. Patent Application Ser. No. 10/141,650 entitled "CURRENT BALANCING CIRCUIT", filed May 7, 2002;

U.S. Patent Application Ser. No. 10/141,325 entitled "CURRENT BALANCING CIRCUIT", filed May 7, 2002;

U.S. patent application Ser. No. 09/904,960, filed Jul. 13, 2001, entitled "BRIGHTNESS CONTROL OF DISPLAYS USING EXPONENTIAL CURRENT SOURCE";

U.S. patent application Ser. No. 10/141,659, filed on May 7, 2002, entitled "MATCHING SCHEME FOR CURRENT CONTROL IN SEPARATE I.C.S.";

U.S. patent application Ser. No. 10/141,326, filed May 7, 2002, entitled "MATCHING SCHEME FOR CURRENT CONTROL IN SEPARATE I.C.S.";

U.S. patent application Ser. No. 09/852,060, filed May 9, 2001, entitled "MATRIX ELEMENT VOLTAGE SENSING FOR PRECHARGE";

U.S. Patent Application Ser. No. 10/274,429 entitled "METHOD AND SYSTEM FOR PROPORTIONAL AND INTEGRAL LOOP COMPENSATION USING A HYBRID OF SWITCHED CAPACITOR AND LINEAR AMPLIFIERS", filed on even date herewith;

U.S. Patent Application Ser. No.10/274,488 entitled "METHOD AND SYSTEM FOR CHARGE PUMP ACTIVE GATE DRIVE", filed on even date herewith;

U.S. Patent Application Ser. No. 10/274,428 entitled "METHOD AND CLAMPING APPARATUS FOR SECURING A MINIMUM REFERENCE VOLTAGE IN A VIDEO DISPLAY BOOST REGULATOR", filed on even date herewith;

U.S. patent application Ser. No. 10/141,648, filed May 7, 2002, entitled "APPARATUS FOR PERIODIC ELEMENT VOLTAGE SENSING TO CONTROL PRECHARGE";

U.S. patent application Ser. No. 10/141,318, filed May 7, 2002, entitled "METHOD FOR PERIODIC ELEMENT VOLTAGE SENSING TO CONTROL PRECHARGE";

U.S. Patent Application Ser. No. 10/274,489 entitled "MATRIX ELEMENT PRECHARGE VOLTAGE ADJUSTING APPARATUS AND METHOD", filed on even date herewith;

U.S. Patent Application Ser. No. 10/274,491 entitled "SYSTEM AND METHOD FOR EXPOSURE TIMING COMPENSATION FOR ROW RESISTANCE", filed on even date herewith;

U.S. Provisional Application No. 60/348,168 filed Oct. 19, 2001, entitled "PULSE AMPLITUDE MODULATION SCHEME FOR OLED DISPLAY DRIVER", filed on even date herewith;

U.S. patent application Ser. No. 10/029,563, filed Dec. 20, 2001, entitled "METHOD OF PROVIDING PULSE AMPLITUDE MODULATION FOR OLED DISPLAY DRIVERS";

U.S. patent application Ser. No. 10/029,605, filed Dec. 20, 2001, entitled "SYSTEM FOR PROVIDING PULSE AMPLITUDE MODULATION FOR OLED DISPLAY DRIVERS";

U.S. Patent Application Ser. No. 10/274,513 entitled "ADAPTIVE CONTROL BOOST CURRENT METHOD AND APPARATUS", filed on even date herewith;

U.S. Patent Application Ser. No. 10/274,490 entitled "PREDICTIVE CONTROL BOOST CURRENT METHOD AND APPARATUS", filed on even date herewith;

U.S. Patent Application Ser. No. 10/274,500 entitled "RAMP CONTROL BOOST CURRENT METHOD", filed on even date herewith;

U.S. Patent Application Ser. No. 10/274,511 entitled "METHOD AND SYSTEM FOR ADJUSTING PRECHARGE FOR CONSISTENT EXPOSURE VOLTAGE", filed on even date herewith;

U.S. Patent Application Ser. No. 10/274,502 entitled "METHOD AND SYSTEM FOR RAMP CONTROL OF PRECHARGE VOLTAGE", filed on even date herewith.

BACKGROUND OF THE INVENTION

1. Field of the Invention

This invention generally relates to electrical drivers for a matrix of current driven devices, and more particularly to methods and apparatus for avoiding droop of precharged column voltage in such devices.

2. Description of the Related Art

There is a great deal of interest in "flat panel" displays, particularly for small to midsized displays, such as may be used in laptop computers, cell phones, and personal digital assistants. Liquid crystal displays (LCDs) are a well-known example of such flat panel video displays, and employ a matrix of "pixels" which selectably block or transmit light. LCDs do not provide their own light; rather, the light is provided from an independent source. Moreover, LCDs are operated by an applied voltage, rather than by current. Luminescent displays are an alternative to LCD displays. Luminescent displays produce their own light, and hence do not require an independent light source. They typically include a matrix of elements which luminesce when excited by current flow. A common luminescent device for such displays is a light emitting diode (LED).

LED arrays produce their own light in response to current flowing through the individual elements of the array. The current flow may be induced by either a voltage source or a current source. A variety of different LED-like luminescent sources have been used for such displays. The embodiments described herein utilize organic electroluminescent materials in OLEDs (organic light emitting diodes), which include polymer OLEDs (PLEDs) and small-molecule OLEDs, each of which is distinguished by the molecular structure of their color and light producing material as well as by their manufacturing processes. Electrically, these devices look like diodes with forward "on" voltage drops ranging from 2 volts (V) to 20 V depending on the type of OLED material used, the OLED aging, the magnitude of current flowing through the device, temperature, and other parameters. Unlike LCDs, OLEDs are current driven devices; however, they may be similarly arranged in a 2 dimensional array (matrix) of elements to form a display.

OLED displays can be either passive-matrix or active-matrix. Active-matrix OLED displays use current control circuits integrated within the display itself, with one control circuit corresponding to each individual element on the substrate, to create high-resolution color graphics with a high refresh rate. Passive-matrix OLED displays are easier to build than active-matrix displays, because their current control circuitry is implemented external to the display. This allows the display manufacturing process to be significantly simplified. Whether internal or external, the control circuitry of OLED displays requires various complicated schemes relating to the supply and timing of different voltages and currents.

In a typical display matrix, OLEDs require a minimum voltage level in order to illuminate. Because providing such minimum voltage to an OLED using only a current source is typically slow, display matrix technology implements the use of a voltage source to precharge OLEDs before the desired illumination time of the OLEDs. Thus, when a current source is applied to illuminate the OLEDs, it is desirable to have the minimum voltage level on the OLEDs to immediately illuminate the OLEDs. However, even when the voltage source is used to precharge the OLEDs, there is an undesirable drop in voltage across the OLED when the current source is applied. This drop may cause undesirable delays in illumination and/or improper illumination. Thus, a system and method for compensating for the delays in illumination and/or improper illumination is needed.

SUMMARY OF THE INVENTION

The system and related methods of the present invention have several aspects, no single one of which is solely responsible for its desirable attributes. Without limiting the scope of this invention as expressed by the claims which follow, its more prominent features will now be discussed briefly.

One aspect of the present invention provides a method of operating a display device. In one embodiment, the precharge supply is used to charge a capacitive aspect of a column of display elements each having a first terminal connected to a column line and a second terminal connected to a row line of the display matrix. The column and row lines, as will be discussed in more detail below, typically connect the display elements in each respective column and row of the display matrix. The precharge supply may be coupled to the column line via a column switch, such as a metal oxide semiconductor (MOS) transistor, for example, whereby, when the switch is closed the precharge supply is conducted through the column line. After the column line has been charged by the precharge supply, the display element is activated by grounding the corresponding row line, thus causing a current to conduct through the display element. The row line may be coupled to ground via a row switch, whereby, when the row switch is closed the row line is grounded.

The precharge supply continues supplying the precharge voltage to the column line, after the row line has been grounded, for a time period sufficient to allow the voltage on the column line to reach a stable value approaching the level of the precharge voltage. When the voltage on the column line substantially reaches the precharge voltage, the column switch is opened causing the precharge period to end. However, the overlapping supply of the precharge voltage, i.e., by closing the column switch, and the current flow through the display element, i.e., by closing the row switch, may prevent a transitory voltage drop in the column line that is typical when the switches are closed simultaneously.

In one embodiment, the invention relates to a display device comprising a voltage source, and a display element configured to emit light. The display element may be electrically connected to the voltage source, and the voltage source may be configured to supply a voltage to the display element for a duration that is longer than the duration necessary to raise a voltage level across the display element to a precharge voltage level.

In another embodiment, the invention relates to a display device comprising means for supplying a voltage and means for emitting light in response to an electrical current. The supplying means may provide a first terminal of the emitting means with the voltage for a duration that is longer than necessary to raise a voltage level across the emitting means to a precharge voltage level.

In yet another embodiment, the invention relates to a display device comprising means for supplying a voltage and a plurality of means for emitting light in response to an electrical current. The plurality of emitting means may be disposed in a matrix pattern having N rows and M columns, for example. In this embodiment, a first terminal of each of the plurality of emitting means in each column may be electrically connected to a column line and a second terminal of each of the plurality of emitting means in each row may be electrically connected to a row line. The display device may further comprise a representative emitting means electrically connected to a row line J and a column line K, such that the supplying means supplies the voltage source to the column line K for a duration that is longer than necessary to raise a voltage level across the representative emitting means to a precharge voltage level.

One aspect of the invention concerns a method of operating a display device comprising a display element. The method comprises applying a voltage source to said display element until a voltage level across said display element reaches a precharge voltage level. The method further comprises waiting a predetermined period of time beyond the time at which the precharge voltage level is reached across the display element. The method may also comprise removing said applied voltage source from said display element.

Another feature of the invention is related to a method of operating a display device comprising a display element having a first terminal and a second terminal. The method comprises precharging a capacitive aspect of said display, conducting a current through said display element, and terminating said precharging after said conducting of said current through said display element.

In one embodiment, the invention is directed to a method of manufacturing a display device. The method comprises forming a matrix of electrically connected display elements having N rows and M columns. The method may further comprise programming a controller with instructions to supply a voltage to a column of display elements for a duration longer than is necessary to raise a voltage level on said column of display elements to a level that is sufficient to illuminate a particular display element electrically connected to said column.

Another aspect of the invention relates to a method of illuminating an OLED having a first terminal and a second terminal. The method comprises supplying said first terminal with a voltage source. The method further includes connecting said second terminal to ground when a voltage across said OLED is about equal to a precharge voltage level. The method may also comprise removing said voltage source from said first terminal.

In another embodiment, the invention concerns a method of operating a display device comprising a plurality of display elements having N rows and M columns, such that a first terminal of each of the display elements in each column is electrically connected to a column line and a second terminal of each of the display elements in each row is electrically connected to a row line, and a representative display element is electrically connected to a row line J and a column line K. The method comprises preparing said representative display element for illumination by applying a voltage source to said column line K before applying a ground signal to said row line J. The method further comprises continuing application of said voltage source to said column line K for a predetermined period of time.

BRIEF DESCRIPTION OF THE DRAWINGS

Various aspects of the present invention will be discussed with reference to the accompanying drawings, which is now briefly described.

DETAILED DESCRIPTION OF THE PREFERRED EMBODIMENT

The following detailed description is directed to certain specific embodiments of the invention. However, the invention can be embodied in a multitude of different ways. The invention is more general than the embodiments which are explicitly described, and is not limited by the specific embodiments but rather is defined by the appended claims. In particular, the skilled person will understand that the invention is applicable to any matrix of current-driven devices subject to substantial capacitance that would otherwise retard the drive operation and reduce the accuracy of the delivered current.

FIGS. 1A, 1B, 2A, and 2B will be discussed to provide an overview of the operation of an LED display. Thereafter, FIGS. 3A, 3B, and 4 will be discussed to provide a detailed description of particular embodiments of the invention.

Construction of OLED Display

Figure 1B:
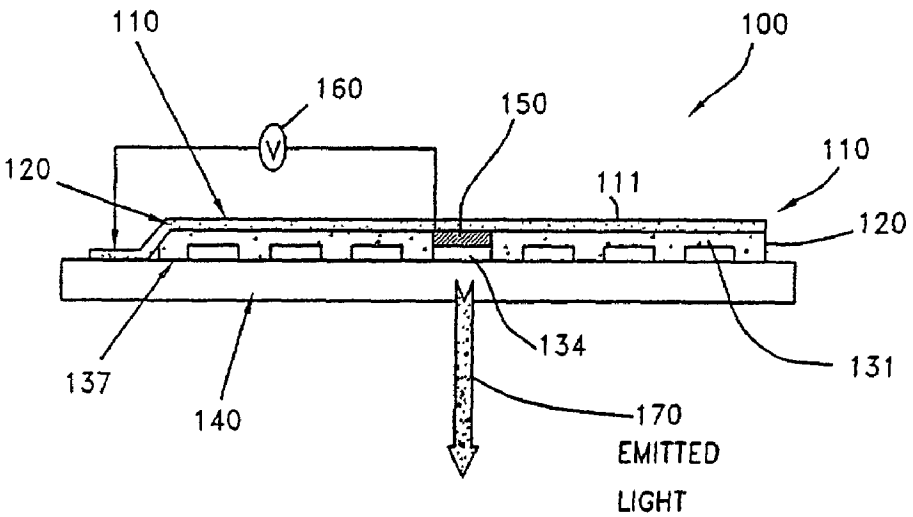
PRIOR ART FIG. 1B
FIG. 1B is a side elevation view of the OLED display of FIG. 1A.
Figure 1A:
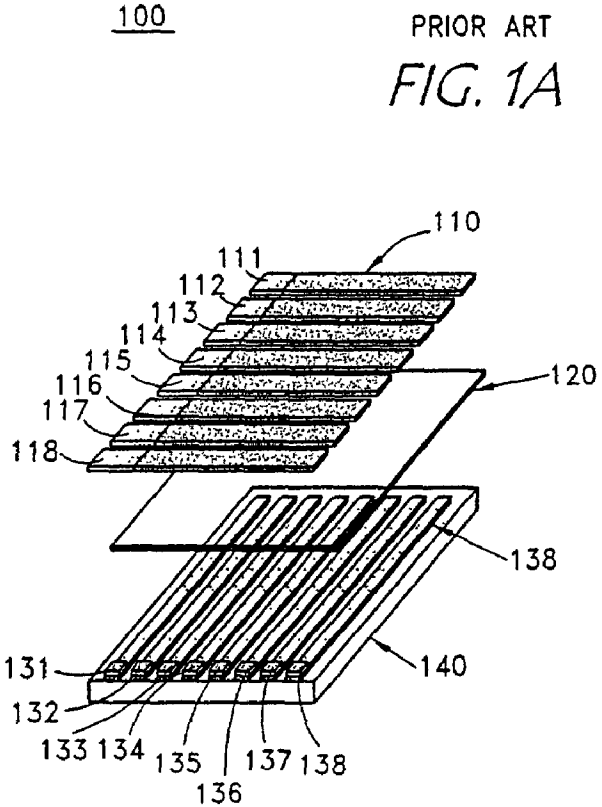
PRIOR ART FIG. 1A
FIG. 1A is a perspective view of a structure of an exemplary OLED display.

FIG. 1A is a perspective view of a structure of an exemplary OLED display and FIG. 1B is a side elevation view of the OLED display of FIG. 1A. According to the illustrations of FIG. 1, a layer having a representative series of row lines, such as parallel conductors 111–118, is disposed on one side of a sheet of light emitting polymer, or other emissive material, 120. A representative series of column lines are shown as parallel transparent conductors 131–138, which are disposed on the other side of sheet 120, adjacent to a glass plate 140. A display cross-section 100 shows a drive voltage V applied between a row 111 and a column 134. A portion of the sheet 120 disposed between the row 111 and the column 134 forms an element 150 which behaves like an LED. The potential developed across this LED causes current flow, so the LED emits light 170. Since the emitted light 170 must pass through the column conductor 134, the column conductors are transparent. Most transparent conductors have relatively high resistance compared with the row conductors 111–118, which may be formed from opaque materials, such as copper, having a low resistivity.

The matrix created by the overlapping row lines and column lines creates conduction paths for a matrix of display elements, where respective display elements are disposed at each point where a row line overlies a column line. There will generally be M×N display elements in a matrix having M rows and N columns. Typical display elements function like light emitting diodes (LEDs), which conduct current and luminesce when voltage of one polarity is imposed across them, and block current when voltage of the opposite polarity is applied. Exactly one display element is common to both a particular row and a particular column, so to control these individual display elements, such as LED's, for example, two driver circuits, one to drive the columns and one to drive the rows, are commonly used. It is conventional to sequentially scan the rows (conventionally connected to a cathode terminal of each of the display elements) with a driver switch to a known voltage such as ground, and to provide another driver, which may be a current source, to drive the columns (which are conventionally connected to an anode terminal of each of the display element).

Figure 2A:
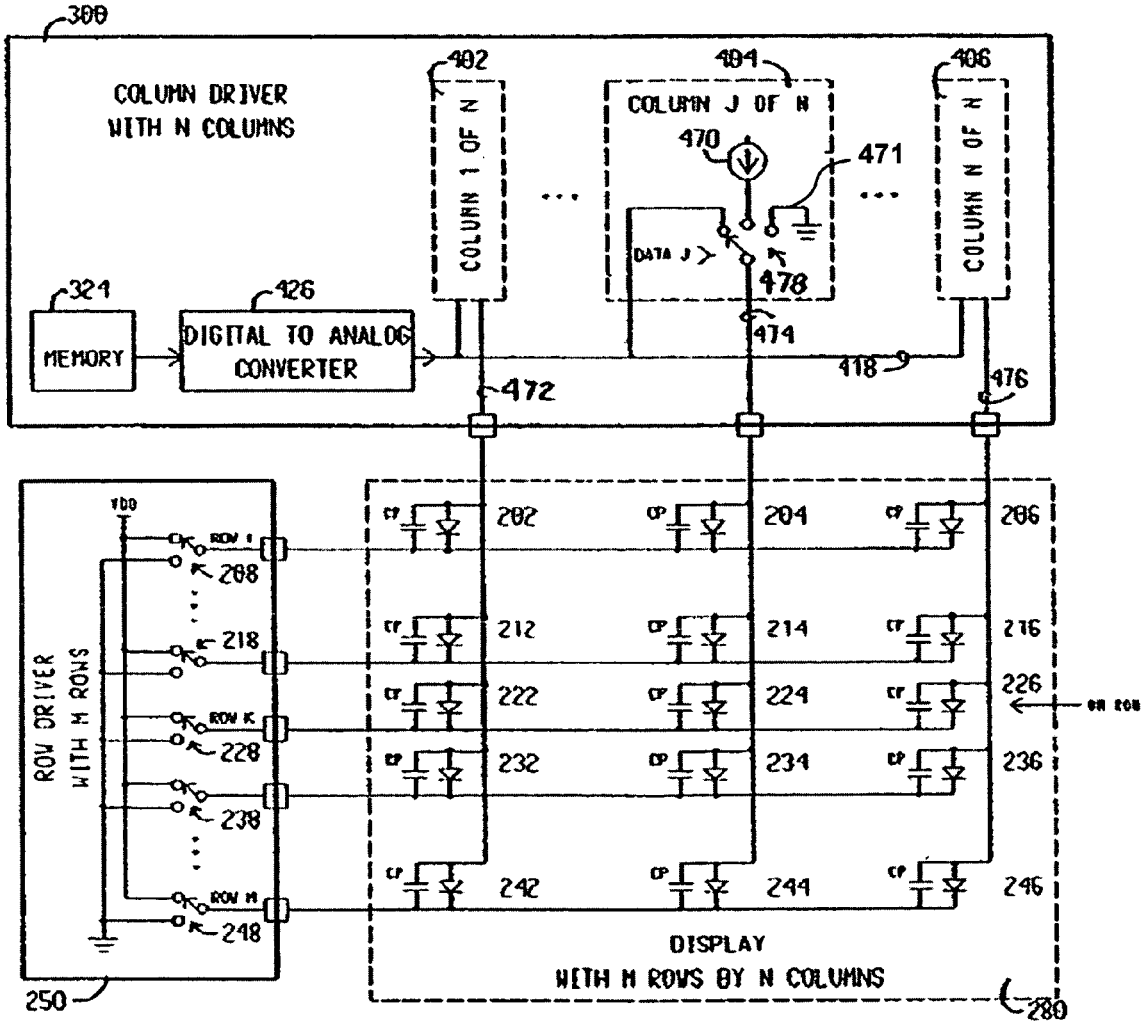
FIG. 2A is a schematic diagram of display and driver circuits during a precharge period.

FIG. 2A is a schematic diagram of display and driver circuits during a precharge period. In the embodiment of FIG. 2A, the display and driver circuits may be implemented in a display device 200 comprising a controller 210 electrically connected to a column driver circuit 300 configured to drive a display matrix 280, which is electrically connected to a scan circuit 250.

In one embodiment, the column drive circuit 300 comprises a first column drive circuit 402, a column J drive circuit 404, and a column N drive circuit 406. Column J drive circuit 404 represents an exemplary column drive circuit which will be referred to below, and column N drive circuit 406 represents the column last drive circuit in the display matrix 280. The operation of each drive circuit 402, 404, and 406 is substantially identical and, therefore, the operation of only column J drive circuit 404 will be described in detail. The column driver circuits 402, 404, and 406 are coupled to column lines 472, 474, and 476, respectively. The column lines connect the column driver circuits to each of the display elements in the respective row of the display matrix 280. For example, column line 472 connects column 1 driver circuit 402 to display elements 202, 212, 222, 232, and 242 in the display matrix 280.

In addition, each of the column driver circuits 402, 404, and 406 may be coupled to a digital to analog converter ("DAC") 426 which converts from digital to analog and provides a precharge voltage Vpr to the column lines 472, 474, and 476 via the column driver circuits 402, 404, and 406. A memory 324 coupled to DAC 426 provides the voltage level to be produced by DAC 426. Because DAC 426 provides the precharge voltage to the display matrix 280, the DAC 426 will be referred to herein as the voltage source 426. In an alternative embodiment, the voltage source 426 may comprise a battery or any other voltage source suitable for supplying a precharge voltage to display elements. Although not limited thereto, this embodiment may use the scheme for determining precharge voltage disclosed in U.S. patent application Ser. No. 09/852,060, filed May 9, 2001, now pending, which is hereby incorporated by reference.

As illustrated in FIG. 2A, the column J drive circuit 404 may comprise a column current source 470, a ground terminal 471, and a column switch 478. In the embodiment of FIG. 2A, the column switch 478 may be switched to connect column line 474 to the voltage source 426, the current source 470, or the ground terminal 471. In an alternative embodiment, column switch 478 may comprise multiple separate switches coupled to column line 474. For example, column switch 478 may comprise two switches, with a first switch alternating between the voltage source 426 and the ground terminal 471, and the second switch alternating between the current source 470 and the ground terminal 471.

The scan circuit 250 comprises a plurality of row switches 208, 218, 228, 238 and 248 which are each configured to couple a respective row of display elements in the display matrix 280 to either a ground terminal 471 or a supply voltage 201 (e.g., Vdd). For example, the row switch 228 couples each of the display elements 222, 224, and 226 in exemplary row K with either ground terminal 471 or supply voltage 201, depending on the position of the row switch 228.

Figure 2B:
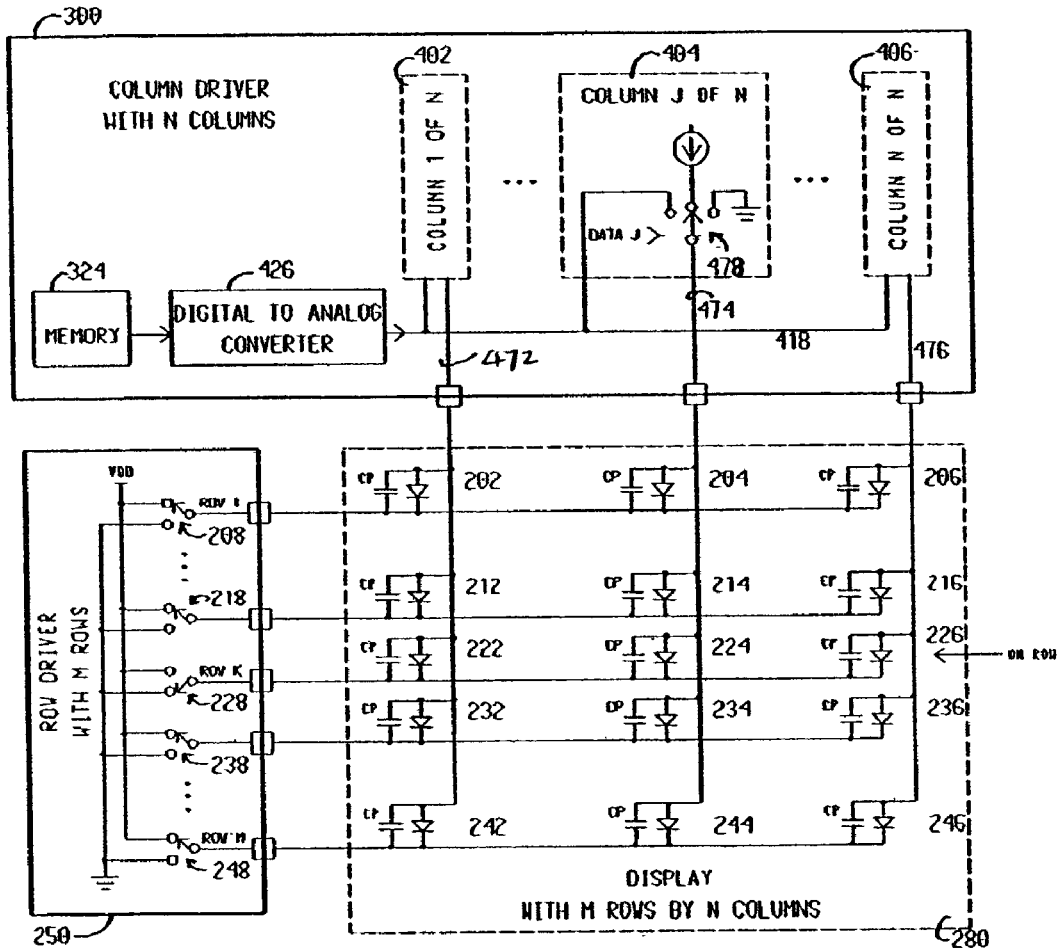
FIG. 2B is the schematic diagram of display and driver circuits of FIG. 2A during an expose period.

The display matrix 280 comprises a plurality of display elements organized in a row and column structure. In the embodiment of FIGS. 2A and 2B, the display matrix 280 comprises M rows and N columns, though only five representative rows and three representative columns are drawn. As such, the embodiments discussed herein are applicable to a display matrix 280 with any number of columns and rows. In the particular embodiment discussed herein, each display element in the display matrix 280 is an OLED device. However, other display elements, such as LEDs or PLEDs, may also benefit from aspects of embodiments discussed herein. FIG. 2A represents each display element within the display matrix 280 as including both an LED component (indicated by a diode schematic symbol) and a parasitic capacitor component (indicated by a capacitor symbol labeled "CP").

The controller 210 may comprise a processor operable to control the operation of the column drive circuit 300 and row scan circuit 250. In one embodiment, the controller 210 may determine the precharge voltage Vpr level by setting a value in the memory 324. In addition, the controller 210 may determine the position of the column switches, e.g. column switch 478, and row switches, e.g. row switch 228. In another embodiment, the column drive circuit 300 comprises a controller and row scan circuit 250 comprises another controller.

FIG. 2B illustrates the same circuitry as that discussed in FIG. 2A, except that column switch 478 is not closed to the precharge voltage, but to a current source 470, for providing exposure, or conduction, of current through selected column lines.

Normal Operation

In operation, information is transferred to the display matrix 280 by scanning each row in sequence. During each row scan period, luminescent OLED display elements connected to the row line are driven via the column lines so as to emit light. For example, a row switch 228 grounds the row to which the cathodes of elements 222, 224 and 226 are connected during a scan of Row K. The column switch 478 connects particular column lines to the current source 470, such that the display elements that are connected to current source 470 in Row K 224 are provided with current. In one embodiment, the current source 470 provides a uniform current sources to all column lines. When an OLED display element is used, the light output is controlled by adjusting the active time of the current source for each particular column line.

When an OLED display element ceases emitting light, the column switch 478 is closed to ground such that the anode terminal of the OLED is grounded, thereby reducing the potential across the OLED display element below the threshold of significant conduction, halting current flow and extinguishing light emission. At the end of the scan period for Row K, the row switch 228 will typically switch the connection to the row line from ground 471 to a supply voltage 201 (e.g., Vdd). Thus, the current will cease to flow through all display elements in Row K and the scan of the next row will begin. The scan process of the next row, e.g., Row L, will proceed in the same manner as discussed above, by adjusting the row switch 238 to ground 250 and adjusting the column switches 402, 404 and 406 to supply a source current to the desired display elements, e.g., 232, 234 and/or 236.

In this embodiment, only one display element (e.g., element 224) of a particular column (e.g., column J) is connected to each row (e.g., Row K), and hence, only one element per column may be "exposed," or luminesce during the scan of a particular row. However, each of the other devices on a particular column line (e.g., elements 204, 214, 234 and 244 as shown, but actually including as many devices as there are rows, typically 63 or more) are connected by the row driver for their respective row (208, 218, 238 and 248 respectively) to the voltage source Vdd. Therefore, the parasitic capacitance, or inherent capacitance, of each of the display elements of the column is effectively in parallel with, or added to, the capacitance of the display element being driven.

In one embodiment, the current source 470 drives a predetermined current through a selected display element, such as the display element 224, for example. However, the applied current will not flow through an OLED element until the parasitic capacitance is first charged to bring the voltage on the column line to a level corresponding to that which the exposure current source would eventually bring it, given sufficient time. That voltage may be, for example, about 6.5V, and is a value which may vary as a function of current, temperature, and pixel aging. Because the scan time might be short, the exposure current source 470 by itself is typically insufficient to perform this charging action on the combined capacitance of all of the parasitic capacitances of the elements connected to the a particular column line, such as column line 474. For at least this reason, a voltage source is employed to precharge the OLEDs. By connecting the column line 474 via the column switch 478 the voltage source 426 prior to connecting the current source 470 to the column line 474, the parasitic column capacitance can be rapidly charged to the correct operating bias corresponding to current source 470 flowing through an OLED element, such as 224.

In an exemplary embodiment, the display matrix 280 may comprise 64 rows and perform 150 scans per second in order to create an acceptably smooth display. This limits the row scan period to 1/(150*64) seconds, or about 100 microseconds (μS). The row scan time may be broken up into 63 segments to allow for controlling the light output from the OLED display element over a range of 0 to 63. Therefore an OLED display element could be on for as little as 100 μS/63 or about 1.6 μS. In one embodiment, parasitic column capacitance is about 1.6 nanofarads (nF), the desired OLED current is about 100 μA, and the OLED steady state voltage is about 5 volts (V) at this current.

The ability of the current source to bring the OLED element to the proper operating voltage is determined by the formula for charging a capacitor which states capacitance (C) times voltage change (dV) equals charging current (I) times charging time (dT) or $C \times dV = I \times dT$. Thus, a 100 μA current source charging a 1.6 nF capacitance for 1.6 μS can only slew the voltage 100 μA×1.6 μS/1.6 nF=0.1 V. The result is that the current through the OLED (as opposed to the current charging the parasitic capacitance) will rise very slowly, and may not achieve the target current even by the end of the scan period. In the example given, if driving from ground the 0.1 V change in OLED voltage would not begin to approach the 6.5V required for proper conduction. Therefore, the current source 470, alone, may be unable to bring an OLED from zero volts to operating voltage during the entire scan period in the circumstance described above.

The Precharge Period

To overcome OLED capacitance and improve the display response, a distinct "precharge" period is implemented during which the voltage on each display element is driven to a precharge voltage value Vpr. During the precharge period, an initial voltage is forced onto the selected column lines (e.g., 472, 474 and 476) prior to activation of the column current drives (e.g., 402, 404 and 406). As a result of the applied precharge voltage value Vpr, the OLED's immediately begin luminescing from the correct voltage level, as if the column lines had been given sufficient time to stabilize in the absence of precharge. The precharge substantially speeds the turn-on, improving the accuracy of the column exposure and the predictability of the luminous output.

Vpr is ideally the voltage which causes the OLED to begin luminescing immediately upon being supplied with a current source. In other words, Vpr is the voltage at which the OLED would settle at equilibrium if conducting a current without the use of a precharge voltage. The precharge may be provided at a relatively low impedance in order to minimize the time needed for the transient response of the column line to settle and achieve Vpr.

At the beginning of a scan period for the exemplary Row K, a row switch 228 connects Row K to a source voltage 201 (e.g., Vdd) to ensure that the selected row of OLED elements is not conducting current during precharge.

For example, in the column J driver 404, a column switch 478 connects a column J line 474 to the voltage source 426. Thus, during a precharge period at the beginning of the scan, the column J line 474 is driven from the relatively low impedance source of the voltage source 426. Each of the parasitic capacitors (CPs) of all of the elements connected to column J (e.g., the CPs of elements 204, 214, 224, 234, and 244) are thus charged quickly to Vpr. If elements 222 or 226, connected to the column lines 472 and 476 respectively, are to conduct current during the scan period, then similar switching will be provided within their respective column drivers 402 and 406.

The duration selected for the precharge period depends upon several factors. Each selected column has a parasitic capacitance and a distributed resistance which will affect the time required to achieve the full voltage on the particular display element. Moreover, the drivers have certain impedances which are common to a varying number of active elements, and their effective impedance will therefore vary accordingly. These factors are used to determine a precharge period that is long enough to allow the column line voltage to reach the precharge voltage.

At the end of the precharge period, the selected elements are "exposed," by switching column switch 478 from the voltage source 426 to the current source 470, which provides a column exposure current, as shown in FIG. 2B. In another embodiment, the column switch may be left in an open position, i.e., not connected to any source, and a separate current source may supply the column exposure current to the column line. The row switch 228 of the row being exposed (row K) is switched to ground 471 to begin the expose period. At the same time, column switches (e.g., 478 in column J driver 404) of the selected display elements (e.g., display element 224) may switch each selected column line (e.g., 474) to the column current sources (e.g., current source 470 in column J driver 404) for the expose period for the selected display elements (e.g., 224).

The skilled person will appreciate that any or all of the display elements connected to a row line of matrix 280 may be selected for exposure. Each individual display element may generally be turned off at a different time during the scan of the element's row, permitting time-based control of the output of each display element. In an embodiment using "off" OLED elements, the column precharge may be skipped entirely to save power.

At the end of an expose period for a particular display element (e.g. 224), the column line (e.g., 474) will generally be disconnected from the current source (e.g., 470) and reconnected to ground 471 or other low voltage, so as to rapidly terminate conduction by the display element. At the end of the available scan period, row K is preferably connected to a supply voltage 201 and precharge for the next row commences as the cycle repeats.

Precharge Switch Latency

When the row line to be scanned is grounded, after the above-described precharge period, a transient fixed drop may occur in the column voltage. When the row line is grounded during the transition from the precharge period to the expose period (e.g., when a column switch moves from the precharge voltage 476 to the current source 470), charge is pulled out of the column through the capacitance of the active display element, thereby causing the total column voltage to be depleted. For example, during the precharge period the column switch 478 connects columns line 474 to the voltage source 426, and row line K is connected to a supply voltage 201 via row switch 228. At the end of the precharge period, the column switch 478 connects to the current source 470 for exposure, and row K is grounded. At this time, the charge coupled through the parasitic capacitance "CP" of display element 224 is pulled out of the parasitic capacitances "CP" of elements 204, 214, 234 and 244, resulting in a new droop of the total column voltage.

The column voltage droop for a particular column line may be defined by the equation $$V_{droop} = \frac{C_p}{C_t} * \Delta V,$$

where $C_p$ is the capacitance of the display element, $C_t$ is the capacitance of all of the display elements in the column, and ΔV is the change of voltage on the row line when it is grounded. In one embodiment, all row lines that are not currently being scanned are coupled to a source voltage Vdd (via row switches) that charges each of the display elements in the row to approximately Vdd. Similarly, when a particular row line is being scanned, the row line is connected to ground 471 (via the corresponding row switch). Thus, in this embodiment, the initial voltage of row line is Vdd, the voltage after the row line has been grounded is 0, and ΔV=Vdd−0=Vdd.

The capacitance of each display element is typically a feature of the materials, electrode dimensions, and electrode spacing of the particular display elements in the display matrix. As such, the capacitances of display elements in a single display matrix are typically about equal. In one embodiment, the capacitance of a single display element is approximately 25 pF. In other embodiments, the capacitance of display elements are lower, 5 pF, for example, or higher, 5 nF, for example, than the exemplary 25 pF capacitance. In an embodiment that has uniform capacitances for all display elements, the total column capacitance may be calculated by multiplying the number of row lines by the capacitance per display element. For example, if a particular display matrix has 64 row lines and an individual display element capacitance of 25 pF, the total column capacitance is 64×25 pF=1.6 nF. Thus, if Vdd=6 v then $V_{droop}$ is 25 pF/1.6 nF×6 v=93.75 mv. Therefore, when the row line is grounded via the row switch, the total column voltage is decreased by 93.75 mv and the display elements in the particular row must charge an additional 93.75 mV before the desired level of illumination is achieved.

In many embodiments the capacitance of all the display elements in inactive rows (i.e., non-scanning rows where the row line is connected to supply voltage 201) is high enough to maintain the voltage of the individual display elements near Vdd, despite the effect of droop induced by the active row line being grounded. For instance, when there are many row lines, the ratio of display element capacitance to column capacitance may be low and the column voltage droop may be a small, insignificant fraction of the total column voltage. For example, in an embodiment with 100 rows, the voltage of the column line will fall only about 1% of Vdd (e.g., 25 pF/2.5 nF=0.01 or 1%) when the row line is grounded. However, in a display matrix having relatively few rows, the drop may be significant. For example, in an embodiment with 10 rows, the voltage of the column line will fall about 10% of Vdd (e.g., 25 pF/250 pF=0.1 or 10%) when the row line is grounded. Thus, as the number of rows in a display matrix decreases the voltage droop of the column line, and thus, of the individual display elements coupled to the column line, increases.

Figure 3A:
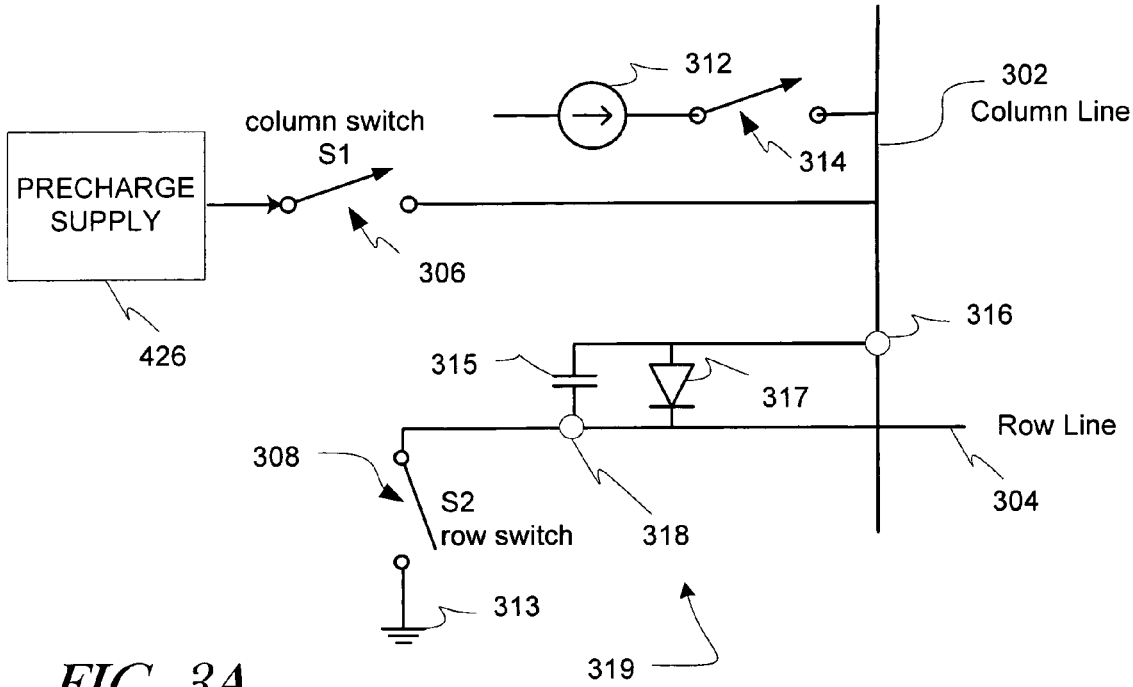
FIG. 3A is a circuit diagram of a single exemplary OLED element in accordance with one embodiment of the invention.

FIG. 3A is a circuit diagram of a single exemplary OLED element in accordance with one embodiment of the invention. The display element 319 illustrated in FIG. 3A represents, for example, any OLED in a display matrix, e.g. OLED 224 of FIG. 2A. As discussed above, the display element 319 includes an LED component 317 and a parasitic capacitor component 315. The anode 316 of each display element 319 is connected to a column line 302 which may also be coupled to other display element anodes not shown in FIG. 3A. The column line 302 is coupled to precharge switch 306 which may be closed to provide a precharge voltage Vpr from precharge voltage source 426 to column line 302. In the embodiment of FIG. 3A, the column line 302 is also coupled to a current switch 314 which may be closed to provide a current source 312 to column line 302. The precharge switch 306 and current switch 314 may perform substantially the same task as the tri-state column switch 478 illustrated in FIGS. 2A and 2B. As such, a column switch 478 may be interchangeable with a combination of a precharge switch 306 and a current switch 314.

The cathode 318 of display element 319 is coupled to a row switch 308 that may be closed to connect the row line 304 to ground terminal 313. Row line 304 may also be coupled to other display element cathodes 318 not shown in FIG. 3A. In an advantageous embodiment, switches 306 and 308 have low resistance and are preferably MOS switches.

The cathode 318 of display element 319 is coupled to a row switch that may be closed to connect the row line 304 to ground terminal 313. Row line 304 may also be coupled to other display element cathodes 318 not shown in FIG. 3A. In an advantageous embodiment, switches 306 and 308 have low resistance and are preferably MOS switches.

Precharge Period

Figure 3B:
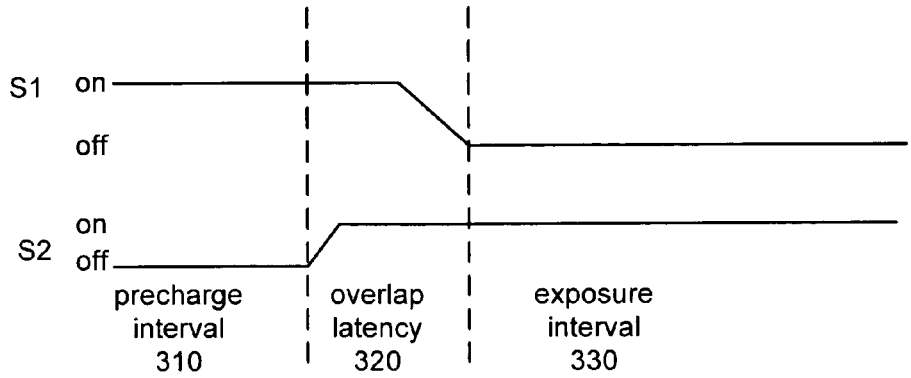
FIG. 3B is a timing diagram illustrating voltage levels of a single OLED element during opening and closing of column and row switches in accordance with one embodiment of the invention.

FIG. 3B is a timing diagram illustrating switch positions and voltage levels associated with a single display element 319 during a precharge, overlap, and expose period, in accordance with one embodiment of the invention. In particular, the horizontal axis of FIG. 3B represents the passage of time, and is divided in to three sequential time periods, namely, a precharge period 310, an overlap period 320, and an expose period 330. The vertical axis of FIG. 3B illustrates the positions of precharge switch 306 and row switch 308, as well as the voltage level V.sub.OLED 316 at the anode of the display element 319 during each of the three time periods on the horizontal axis. The three time periods will be discussed below with specific reference to the elements of FIG. 3A. However, the timing diagram in FIG. 3B represents, for example, the timing of a precharge, overlap, and expose periods of any display elements, e.g. OLEDs, in a display matrix, e.g. display matrix 280, of FIG. 2A.

Overlap Period

FIG. 3B shows that the connection between the column line 302 and the voltage source 426 is maintained during an overlap period 320 after the row line 304 has been connected to ground 313 by closing row switch 308. As discussed above, immediately after the row switch 308 is closed, $V_{OLED}$ 316 droops to a level that is less than the precharge level during droop period 324. However, during the overlap period 320 of FIG. 3B, the precharge switch 306 holds the column line 302 connected to the voltage source 426 so the column line voltage may quickly re-charge to the precharge voltage Vpr after the row line 304 is grounded.

The droop induced by grounding the active/scanned row line at the end of the precharge period may be reduced by maintaining the connection of the voltage source 426 to the column lines during an overlap period after the row line is grounded. The precharge overlap period 320 (FIG. 3B) is the period of time that the voltage source 426 is coupled to the column line after the respective row line has been grounded. In an advantageous embodiment, the overlap period 320 is a function of the column switch impedance, precharge voltage source impedance, and column capacitance. For example, in one embodiment, the length of the overlap period 320 may be defined by the formula: $T_{overlap}=K(Z_{switch}+Z_{PVS})*C_{column}$, where K is a multiplier selected by system design, $Z_{switch}$ is the impedance of the column switch, $Z_{PVS}$ is the impedance of the precharge voltage source, and $C_{column}$ is the total column capacitance.

As an illustration, consider a system having $Z_{switch}$=10 Ohms, $Z_{PVS}$=10 Ohms, and $C_{column}$=1.6 nF. The overlap period 320 is K(10 Ohms+10 Ohms)*1.6 nF=32 *K nanoseconds. The value of K is typically set to a value greater than one to provide a longer overlap period 320 than is theoretically necessary, thus ensuring that, in operation, the column line has sufficient time to reach the precharge voltage level after grounding the row line. Thus, K may be set to any value, but is preferably greater than one, and in an advantageous embodiment may be between 2 and 5. With respect to the example above, if K is set to 3, the overlap time will be 3*32 nanoseconds, or 96 nanoseconds.

The recharge time from the drooped state 322 is typically shorter when the connection between the voltage source 426 and the column line 302 is maintained during the overlap period 320 than it would be if the recharging action were supplied only by the column current source 312. For example, with a current source 312 of only 10 ua and a droop voltage of 500 mV, the recharge time (in the absence of overlap 320) is about 80 usec for a column line 302 having a total column capacitance of 1.6 nF. More specifically, applying the formula discussed earlier for purposes of calculating a voltage charge, given a specific capacitance, charge current, and charge time, the time required to create a specific voltage charge may be defined by the formula $$dT = \frac{C \times dV}{I}.$$

Thus, if C=1.6 nF, dV=500 mV, and I=10 ua, then $$dT = \frac{1.6\text{nF} \times 500\text{ mV}}{10ua} = 80u\text{sec}.$$

Since typical row-scan times are 100 usec–200 usec, this is clearly unsatisfactory. With the addition of overlap period 320, the recharge time can be reduced to below 200 usec, and in an advantageous embodiment, to as little as 1 usec–10 usec. Thus, with the overlap period 320, $V_{OLED}$ 316 remains substantially constant throughout the overlap period 320 and in to the expose period 330, ensuring that the OLED, or other display element, will be illuminated at the proper level at the beginning of the expose period 330. Alternatively, the use of overlap period 320 may eliminate delays in LED illumination at the beginning of the expose period 330.

Expose Period

During the expose period 330 a current flow is induced through the display element 319 so that the display element 319 may illuminate. With the use of the overlap period 320, the expose period 330 can begin with $V_{OLED}$ substantially equal to the precharge voltage Vpr. In particular, at the end of the overlap period 320 the precharge switch 306 opens, thus breaking the electrical connection between the voltage source 426 and the display element 319. Because $V_{OLED}$ is substantially equal to the precharge voltage Vpr at the beginning of the expose period 330, i.eΔ. when the precharge switch 306 has been opened, the voltage across the display element 319 is sufficient to properly illuminate the display element 319 without additional voltage charging.

Figure 4:
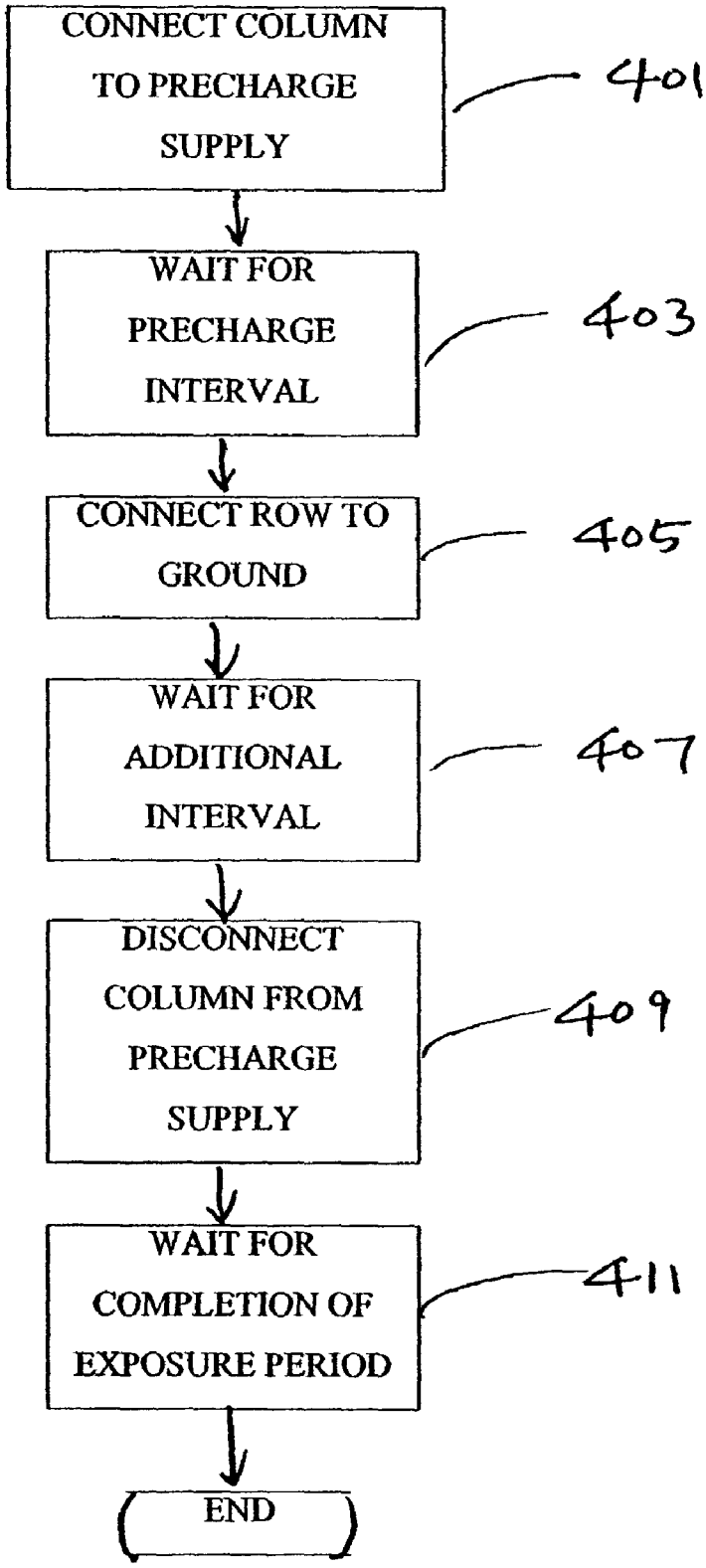
FIG. 4 is a flow chart of the precharge and exposure processes in accordance with one embodiment of the invention.

FIG. 4 is a flow chart illustrating the operation of the precharge and activation of a row scan as described above in FIGS. 3A and 3B.

In step 401, the precharge switch 306 closed, thus connecting the column line 302 to the voltage source 426. This state persists during the precharge period 310 (FIG. 3B) as shown in step 403.

In step 405, the row switch 308 is closed, thus connecting the row line 304 to ground 313. More specifically, after the column line 302 is precharged to the precharge voltage, the row switch 308 is closed in order to connect the row line 309 for scan to the ground 313.

In step 407, the precharge switch 306 remains closed during a portion of an overlap period 320 (FIG. 3B) as the column line voltage settles. More specifically, after the transition of the row line 309 to ground 313, i.e., by closing the row switch 308, the voltage level on the column line 302 may be reduced by the capacitances of the inactive display elements in the same column line 302. Thus, by maintaining the precharge voltage on the column line 302 after the row line 309 has been grounded, the voltage on the column line 302 may quickly return to near the precharge voltage level.

In step 409 the precharge switch 306 is opened, disconnecting the column line 302 from the voltage source 426. At this time, the column line 302 can be driven by a current source 312 to sustain the exposure at the correct precharge voltage level for a predetermined time. In other words, with reference to FIG. 3A, at the end of the overlap period 320, the precharge switch 306 opens and current switch 314 closes, thus supplying the exposure current to the column line 302.

Accordingly, with the precharge switch latency of step 407, the precharge level of an OLED display is improved by avoiding or minimizing column voltage droop after the row line 304 is grounded. As those skilled in the art will realize, this precharge latency may be particularly useful for an OLED display having a small number of rows, for example fewer than 50 rows or 20 rows. However, it is contemplated that overlapping the application of a precharge voltage with activation of a display element, as disclosed herein, may be used in a display system with any size display matrix and using any type of display elements.

Specific parts, shapes, materials, functions and modules have been set forth, herein. However, a skilled technologist will realize that there are many ways to fabricate the system disclosed herein, and that there are many parts, components, modules or functions that may be substituted for those listed above. While the above detailed description has shown, described, and pointed out the fundamental novel features of the invention as applied to various embodiments, it will be understood that various omissions and substitutions and changes in the form and details of the components illustrated may be made by those skilled in the art, without departing from the spirit or essential characteristics of the invention.

What is claimed is:

1. A display device comprising:

a voltage source;

a first switch configured to electrically connect a first terminal of said display element to said voltage source;

a second switch configured to electrically connect a second terminal of said display element to ground; and a display element configured to emit light, said display element being electrically connected to said voltage source, wherein said first switch is configured to connect said voltage source to said display element during a first time period and wherein said second switch is configured to connect said second terminal to ground during a second time period and wherein said first time period begins before said second time period and overlaps said second time period for a predetermined period of time.

2. The display device of claim 1, wherein said display element is an OLED.

3. The display device of claim 1, wherein said display element is an OLED.

4. The display device of claim 1, wherein said precharge voltage level is substantially equal to the voltage level which causes the display element to begin luminescing substantially immediately upon receiving current from a current source.

5. The display device of claim 1, wherein said first switch and said second switch each comprise a metal oxide semiconductor (MOS) transistor.

6. The display device of claim 1, wherein a current source is applied to said display element after said predetermined time period.

7. The display device of claim 1, further comprising:

a plurality of display elements having N rows and M columns, such that a first terminal of each of the display elements in each column is electrically connected to a column line and a second terminal of each of the display elements in each row is electrically connected to a row line.

8. The display device of claim 7, further comprising:

a plurality of M column driver circuits, each being electrically connected to a respective column line; and a plurality of N row driver circuits, each being electrically connected to a respective row line.

9. The display device of claim 8, wherein each of said plurality of M column driver circuits comprises a first switch configured to electrically connect each of said respective column lines to said voltage source, and each of said plurality of N row driver circuits comprises a second switch configured to electrically connect each of said respective row lines to said ground.

10. The method of claim 1, wherein the predetermined period of time is a period of time in the range of 1–10 microseconds.

11. The method of claim 1, wherein the predetermined period of time is a period of time sufficient to settle the voltage level across said display element after said second switch connects said second terminal to ground.

12. A display device comprising:

a voltage source;

a plurality of display elements having N rows and M columns, such that a first terminal of each of the display elements in each column is electrically connected to a column line and a second terminal of each of the display elements in each row is electrically connected to a row line;

a first switch configured to electrically connect a first terminal of at least a selected one of the display elements to the voltage source;

a second switch configured to electrically connect a second terminal of the selected display element to ground;

a representative display element electrically connected to row line J and column line K; and a controller configured to use the first switch to apply said voltage source to said column line K for a first time period, the controller further configured to use the second switch to apply a ground signal to said row line J for a second time period, wherein said first time period begins before said second time period and overlaps said second time period for a predetermined period of time.

13. The display device of claim 12, wherein each of said plurality of display elements comprises an OLED.

14. The display device of claim 12, further comprising:

a plurality of M column driver circuits, each being electrically connected to a respective column line;

a plurality of N row driver circuits, each being electrically connected to a respective row line;

wherein each of said plurality of M column driver circuits comprises a first switch configured to electrically connect each of said respective column lines to said voltage source, and each of said plurality of N row driver circuits comprises a second switch configured to electrically connect each of said respective row lines to said ground;

a controller configured to control the operation of said plurality of M column driver circuits and said plurality of N row driver circuits such that, with respect to said representative display element, said voltage source is electrically connected to said column line K before applying said ground signal to said row line J, and thereafter the electrical connection between said voltage source and said column line K is maintained for a predetermined period of time.

15. The display device of claim 12, wherein after said predetermined period of time a current source is electrically connected to each of said first terminals of said display elements in said column K.

16. A display device comprising:

means for supplying a voltage;

means for emitting light in response to an electrical current;

first means for electrically connecting said means for emitting light to said voltage source, wherein the first means comprises a first switch configured to electrically connect the emitting means to the supplying means; and second means for electrically connecting said means for emitting light to ground, wherein the second switch configured to electrically connect the emitting means to ground, wherein first means for electrically connecting comprises means for connecting said means for supplying to said means for emitting during a first time period and wherein said second means for electrically connecting comprises means for connecting said means for emitting light to ground during a second time period and wherein said first time period begins before said second time period overlaps said second time period for a predetermined period of time.

17. The display device of claim 16, wherein said precharge voltage is substantially equal to the voltage level which causes the emitting means to begin luminescing immediately upon being supplied with said electrical current.

18. A display device comprising:

means for supplying a voltage;

a plurality of means for emitting light in response to an electrical current, wherein said plurality of emitting means are disposed in a matrix pattern having N rows and M columns, such that a first terminal of each of said emitting means in each column is electrically connected to a column line and a second terminal of each of said emitting means in each row is electrically connected to a row line;

means for electrically connecting said supplying means and said column line K via a first switch;

means for electrically connecting a ground terminal and said row line J via a second switch; and a representative emitting means electrically connected to a row line J and a column line K, wherein said supplying means supplies said voltage source to said column line K during a first time period using the first switch and wherein said means for electrically connecting said ground terminal connects said second terminal to ground during a second time period using the second switch and wherein said first time period begins before said second time period and overlaps said second time period for a predetermined period of time.

19. A method of manufacturing a display device, comprising:

forming a matrix of electrically connected display elements having N rows and M columns;

providing a first switch configured to electrically connect at least a selected one of the display elements to a voltage source;

providing a second switch configured to electrically connect the selected display element to ground; and programming a controller with instructions to supply a voltage to a column of display elements during a first time period using the first switch and to connect a row of display elements to ground during a second time period using the second switch, wherein said first time period begins before said second time period and said first time period overlaps said second time period for a predetermined period of time.

20. The method of claim 19, wherein said display elements are OLEDs.

21. The method of claim 19, wherein said display elements are PLEDs.

22. A method of operating a display device comprising a plurality of display elements having N rows and M columns, such that a first terminal of each of the display elements in each column is electrically connected to a column line and a second terminal of each of the display elements in each row is electrically connected to a row line, and a representative display element is electrically connected to a row line J and a column line K, the method comprising:

providing a first switch configured to electrically connect a selected one of the display elements to a voltage source;

providing a second switch configured to electrically connect the selected display element to ground;

preparing said representative display element for illumination by applying a voltage source to said column line K for a first time period beginning before applying a ground signal to said row line J for a second time period, and thereafter continue applying said voltage source to said column line K for a predetermined period of time, wherein said first time period begins before said second time period and overlaps a portion of said second time period for said predetermined period of time.

23. The method of claim 22, wherein said display element is an OLED.

24. The method of claim 23, wherein after said predetermined period of time a current source is electrically connected to said column line K.

25. The method of claim 22, wherein said preparing is concurrently performed on at least some of said plurality of display elements in a particular row.

* * * * *

UNITED STATES PATENT AND TRADEMARK OFFICE

CERTIFICATE OF CORRECTION

PATENT NO. : 7,126,568 B2
APPLICATION NO. : 10/274421
DATED : October 24, 2006
INVENTOR(S) : Robert LeChevalier It is certified that error appears in the above-identified patent and that said Letters Patent is hereby corrected as shown below:

On the Title page, in column 2, under Other Publications, line 2, delete "Nol." and insert -- No. --, therefor.

In column 9, line 18, after "to the" delete "a".

In column 10, line 61, after "element" delete "(e.g." and insert -- (e.g., --, therefor.

In column 11, line 55, delete "6 v" and insert -- 6v --, therefor.

In column 15, line 30, in Claim 3, delete "OLED." and insert -- PLED. --, therefor.

In column 16, line 46, in Claim 14, delete "a" and insert -- said --, therefor.

Signed and Sealed this

First Day of May, 2007

JON W. DUDAS
*Director of the United States Patent and Trademark Office*